United States Patent [19]

Brand et al.

[11] 3,941,024

[45] Mar. 2, 1976

[54] ELECTRICAL MUSICAL INSTRUMENT WITH AUTOMATIC SEQUENTIAL TONE GENERATION

[75] Inventors: John R. Brand, Mt. Prospect, Ill.; David J. Mate, San Diego, Calif.

[73] Assignee: Warwick Electronics, Inc., Chicago, Ill.

[22] Filed: Nov. 20, 1974

[21] Appl. No.: 525,465

[52] U.S. Cl. ..... 84/1.01; 84/1.03; 84/1.24; 84/DIG. 22

[51] Int. Cl.[2] ..... G10H 1/00; G10H 5/00

[58] Field of Search ..... 84/1.01, 1.03, 1.17, 1.24, 84/DIG. 12, DIG. 22

[56] References Cited

UNITED STATES PATENTS

| | | | |
|---|---|---|---|
| 3,617,602 | 11/1971 | Kniepkamp | 84/1.17 |
| 3,651,729 | 3/1972 | Adachi | 84/1.17 |
| 3,718,748 | 2/1973 | Bunger | 84/1.24 |
| 3,725,562 | 4/1973 | Munch, Jr. et al. | 84/1.24 |
| 3,842,184 | 10/1974 | Kniepkamp et al. | 84/1.01 |
| 3,854,366 | 12/1974 | Deutsch | 84/1.24 |

*Primary Examiner*—L. T. Hix
*Assistant Examiner*—Stanley J. Witkowski
*Attorney, Agent, or Firm*—Wegner, Stellman, McCord, Wiles & Wood

[57] ABSTRACT

An electronic organ includes digital circuitry for automatically enabling in a sequential manner a plurality of gates to pass tone control signals to keyers which generate corresponding tone output signals. The digital circuitry includes a tone counter which sequentially enables a plurality of tone gates, and an octave counter which sequentially enables output gates having inputs from the tone gates. A clock generates clock pulses which are rapidly counted by the note counter to sequentially scan the note gates. When a tone control signal is passed, the output of a note detector causes a divider to be inserted between the clock and the note counter to maintain enabling of the note counter.

15 Claims, 2 Drawing Figures

ELECTRICAL MUSICAL INSTRUMENT WITH AUTOMATIC SEQUENTIAL TONE GENERATION

BACKGROUND OF THE INVENTION

The invention relates to an electrical musical instrument having improved digital circuitry for automatically producing a sequential series of related tones.

Electronic organs have included digital circuitry for producing a sequential series of related tones. Such special effects are generally provided on electronic organs having a lower or accompaniment keyboard manual and an upper or melody keyboard manual. In particular, the execution of the arpeggio, a glissando, or a strum musical effect either requires an accomplished organist, or automatic circuitry which allows an amateur to accomplish these special sequential musical effects.

Prior digital circuitry for automatically producing an arpeggio have included a plural stage counter stepped by clock pulses. When a particular tone is to be produced, the counter stage is converted from a monostable flip-flop to a bistable flip-flop in order to emit a lengthened pulse which gates a tone signal to a keyer. A variable speed clock controls the bistable flip-flops in order to produce a sequential series of tone signals. An example of such a digital circuit is shown in U.S. Pat. Nos. 3,718,748 and 3,725,562.

Digital circuitry for automatic arpeggio playing by the use of standard digital logic, rather than specialized digital logic as above, is shown in the pending application of Roman A. Adams, Ser. No. 418,577, filed Nov. 23, 1973, and assigned to the same assignee as the present application. In the Adams application, the digital circuitry includes an octave counter, and a tone counter stepped by a quadrature clock, to sequentially enable three input gates having a tone producing input, a note counter input, and an octave counter input. When one of these gates passes an output signal to a keyer, a note detector stops the quadrature clock to cause the count to be held for an adjustable tone interval, as controlled by a monostable multivibrator having a time adjustable unstable state.

SUMMARY OF THE INVENTION

In accordance with the present invention, an improved digital circuit is disclosed for automatic sequential tone generation. A note counter is stepped by clock pulses from a two-speed clock formed by a high frequency clock and a divider insertable in the clock path for effectively lengthening the clock pulses. Separate note gates are controlled by the note counter to pass note output signals to a plurality of octave gates which are enabled by an octave counter to cause the note output signals to be passed in a selected octave. The resulting circuit is of simple and straightforward design, and allows increased use of standard digital components.

One object of the present invention is the provision of an improved digital circuit for automatic sequential tone generation in an electrical musical instrument. The digital circuit includes a clock for stepping counters, and a divider insertable in the clock path for effectively lengthening of the clock pulses to maintain tone production. Both types of clock pulses are coupled to a note counter having outputs to note gates which pass signals to a plurality of octave gates controlled by an octave counter.

Other features and advantages of the invention will be apparent from the following description and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

DESCRIPTION OF THE PREFERRED EMBODIMENT

Figure 1:
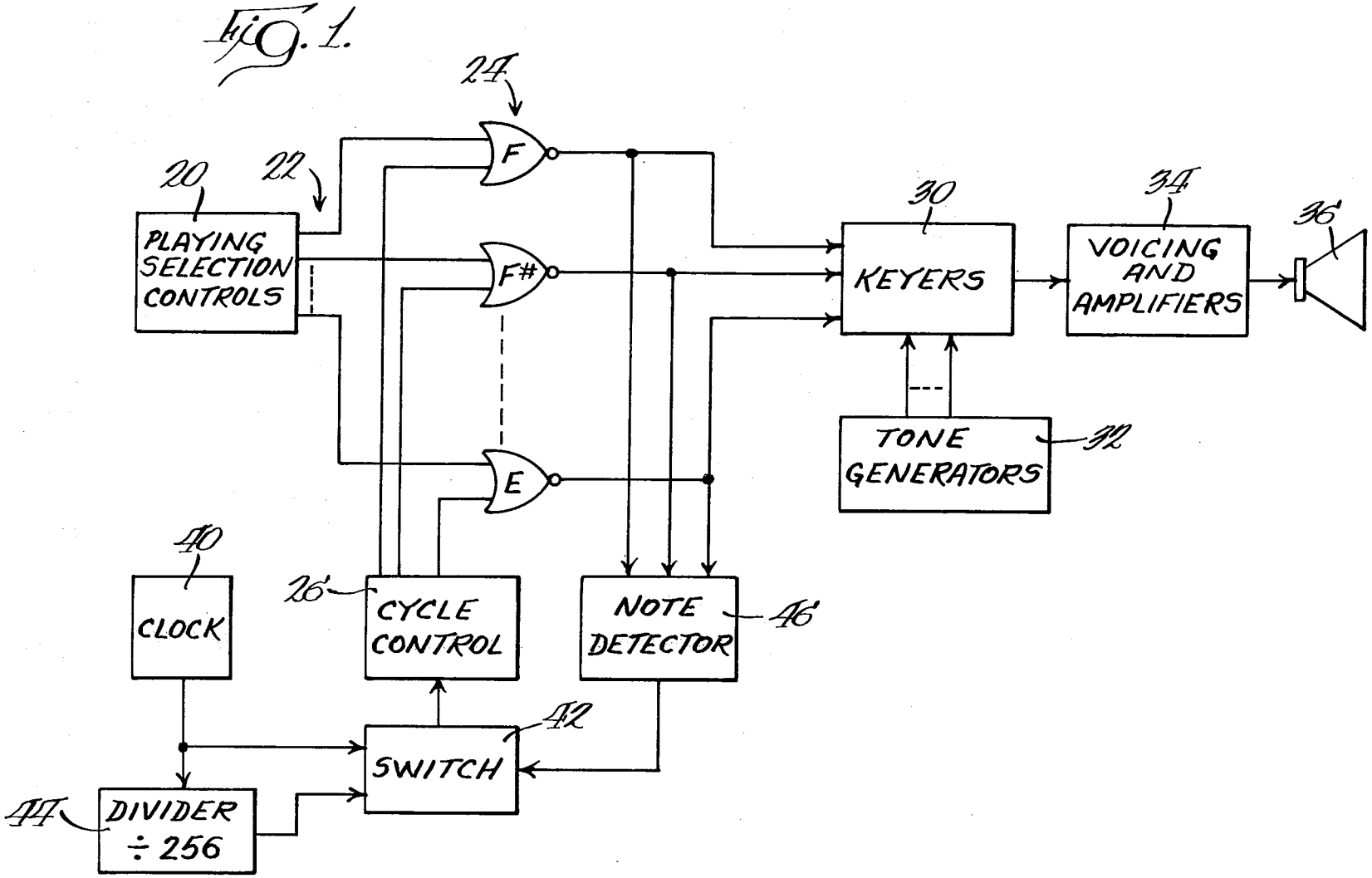
FIG. 1 is a block diagram of an electronic organ having improved digital circuitry for automatic sequential enabling of related tones.

Turning to FIG. 1, an electronic organ or other keyboard electrical musical instrument includes playing selection controls 20 which may comprise the key switches of the lower keyboard. Individual note control signals can be generated over a plurality of note output lines 22 which are coupled to a corresponding plurality of scanning gates 24, one scanning gate being provided for each note. When one of the scanning gates 24 is enabled by the output of a cycle control 26, and that gate 24 also has a note control signal from the playing selection control 20, then a note output signal is passed to keyers 30 which also has inputs from tone generators 32 to pass corresponding tone signal to voicing circuitry 34 for processing before being coupled to a loudspeaker 36. For simplification, FIG. 1 shows only the sequential selection circuitry associated with one octave of the electronic organ.

Cycle control 26 sequentially enables each of the scanning gates 24 in order to produce a sequential musical effect such as an arpeggio. The cycle control 26 is responsive to a two-speed clock means to rapidly scan through the scanning gates 24 which do not have a note control signal coupled thereto, and to slowly scan through gates 24 which do have note control signals coupled thereto. In particular, a high frequency clock 40 generates clock pulses which are coupled to a switch 42 and also to a divider 44 which divides by 256. The divided clock pulses, which are of substantially lower frequency and of substantially longer duration, are also coupled to the switch 42. The switch 42 normally couples the clock 40 directly to the cycle control 26 to cause it to count and thus sequentially enable each scanning gate 24.

When a scanning gate 24 also has a note control signal at its other input, an output signal is passed to the keyers 30. The output signal is also detected by a note detector 46 to cause the switch 42 to insert the divider 44 in the path between the clock 40 and the cycle control 26. The clock pulse which had stepped the cycle control 26 to the now actuated scanning gate 24 is held or maintained until the divider 44 has counted 256 further clock pulses. At this time, the count pulse terminates and thus disables or blocks the gate 24, thereby disabling the note detector 46 so that the switch 42 returns to connecting the clock 40 directly to the cycle control 26. The cycle control 26 will now rapidly step and enable each gate 24 until another note control signal is passed by the particular scanning gate being enabled at that time.

The notes which are sounded follow each other without noticeable gaps between them due to the high speed of the clock 40. Thus, the clock 40 has a frequency selected so that all scanning gates 24 can be sequentially enabled within a short time period which cannot be noticed by a listener. The divider 44 is selected to have a sufficient number of stages so that the resulting clock pulse equals the desired note interval for sounding a tone during an arpeggio operation.

Figure 2:
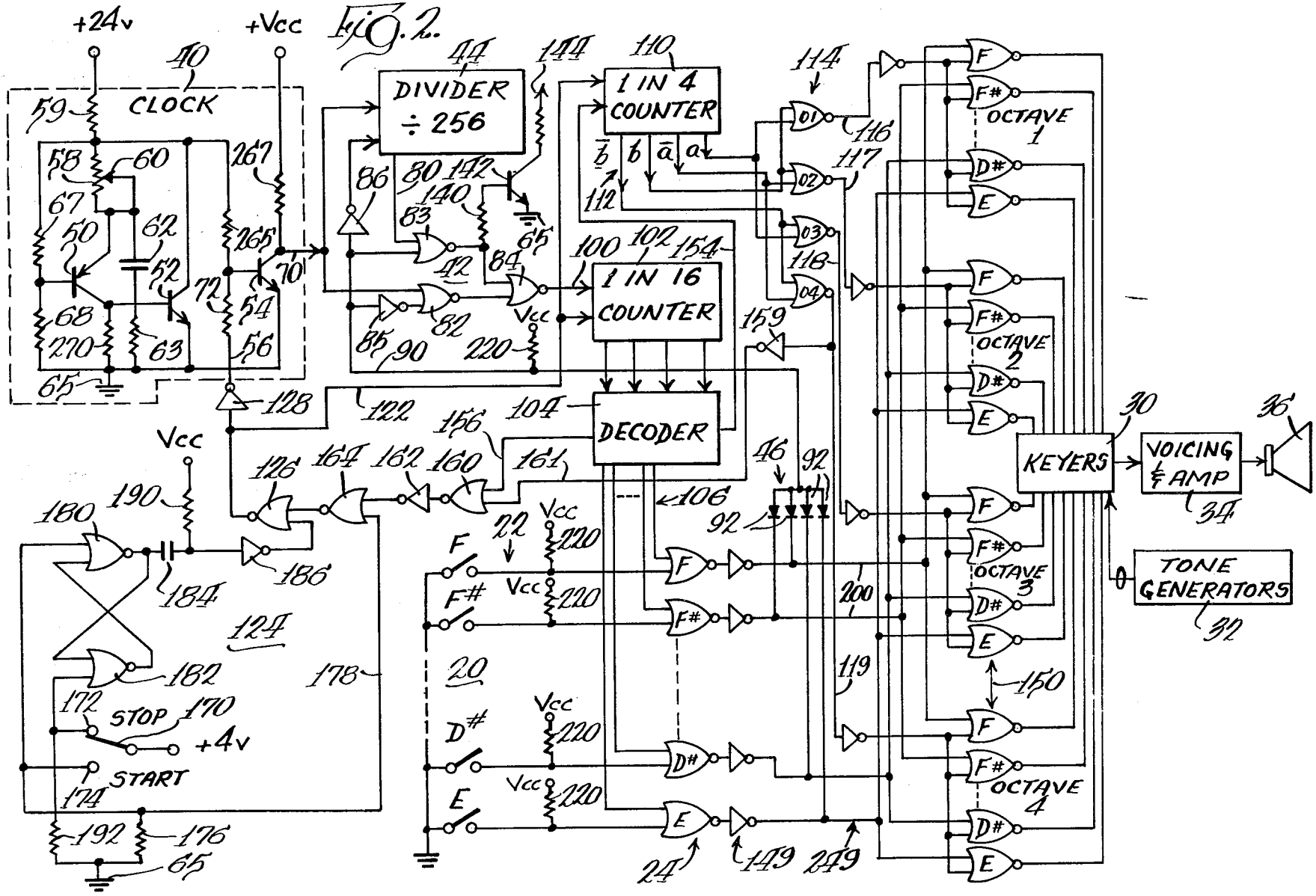
FIG. 2 is a schematic diagram of the improved digital circuitry shown in block form in FIG. 1.

In FIG. 2, a schematic diagram is illustrated of the digital circuitry shown in block form in FIG. 1, including additional circuitry to provide a musical range of four octaves. The lowest frequency note is F, of the lowest octave which herein is labeled Octave 1 or 01. Playing controls 20 comprise twelve note switches each coupled to all corresponding note keyswitches so that when any note keyswitch is actuated by the organist, such actuation closes the corresponding switch 20. For example, selection of note F in any octave will close the F switch 20, thereby passing a note control signal on line 22 to the note scanning gates 24. Additional conventional circuitry (not illustrated) provides individual actuation of the F keyer in the selected octave when the F note keyswitch is depressed, for conventional sounding of tones. Thus, the illustrated circuitry is only concerned with implementing of automatic sequential special effects, such as arpeggio.

The logic circuitry of FIG. 2 is implemented with NOR gates. The response of a NOR gate is a 1 bit output only when both inputs have 0 bits. For negation, single input NOR gates are utilized. It should be understood that different types of logic and components can be used, as desired.

Clock 40 consists of transistors 50 and 52 which form a free-running regenerative oscillator and an output transistor 54 which can be gated on or blocked by the signal level on an enabling or start line 56. The emitter of transistor 50 is coupled through a variable resistance 58 of a potentiometer and resistor 59 to a +24 volt DC source. The wiper 60 of the potentiometer is coupled through a capacitor 62 and a resistor 63 to a source of reference potential or ground 65. A pair of voltage divider resistors 67 and 68 provide positive voltage to the base of transistor 50. The collector of transistor 50 is coupled through a resistor 270 to ground 65, and also is directly coupled to the base of transistor 52. The collector of transistor 52 is coupled through a resistor 265 to the base of transistor 54, which has its collector coupled through a load resistor 267 to a positive DC source Vcc. The collector of transistor 54 also connects to the clock output line 70. The enabling input line 56 is coupled through a resistor 72 to the base of transistor 54.

In operation, transistor 50 and 52 are normally off due to base biasing and the capacitor 62 charges through the potentiometer. When the charge reaches a predetermined level, the voltage at the emitter of transistor 50 is sufficient to forward bias the transistor, causing it to draw current. The current through the collector of transistor 50 forward biases transistor 52, causing it to conduct and thereby increases the current flow through resistor 59. The resulting increase in voltage drop across resistor 59 biases transistor 50 harder into conduction and by regenerative action both transistors 50 and 52 are driven into saturation.

Capacitor 62 is quickly discharged by the emitter current of transistor 50 and by collector current of transistor 52 to a low voltage. When capacitor 62 has discharged to a voltage that produces insufficient current through transistor 50 to maintain saturation bias on transistor 52, regenerative action quickly returns both transistors to a cutoff condition. One cycle of operation is now complete and the voltage again begins to build across capacitor 62. The fluctuating or oscillating voltage level at the collector of transistor 52 is coupled through resistor 65 to the output transistor 54 which amplifies the clock pulse and couples it to the output line 70. The output transistor 54 will couple the clock pulse to output line 70 as long as the enabling line 56 has a 0 bit thereon, representing ground voltage level.

The output clock pulse is coupled to the divider 44 and to the switch 42. The divider 44 may comprise an eight stage ripple counter so that a division ratio of 256 is accomplished. The divided clock pulse is then coupled over an output line 80 to the switch 42.

Switch 42 consists of NOR gates 82, 83 and 84, and NOT gates 85 and 86. The inputs of the NOT gates 85, 86 and one input of NOR gate 83 are coupled to an output line 90 from the note detector 46. The note detector 46 comprises a plurality of semiconductor diodes 92 each having their respective anodes coupled to line 90 and their cathodes coupled to the note scanning output lines 200. When no tone keyswitch is actuated, all switches 20 are open and all lines 22 have 1 bits thereon by Vcc applied through resistors 210. All of the outputs from NOR gates 24 have 0 bits. All of the outputs from NOT gates 149 have 1 bits, lines 200 have 1 bits and line 90 carries a 1 bit. The 1 bit is inverted by NOT gate 85 to a 0 bit to NOR gate 82. As the clock pulse goes low, the 0 bit on the other input of NOR gate 82 results in a 1 bit output which is coupled to NOR gate 84 to produce a 0 bit on the counting input 100 of a note counter 102. The alternating high and low clock pulses on line 70 thereby create alternating 0 and 1 bits at input 100, in order to cause the cycle control 26 to count.

Cycle control 26 includes note counter 102 which comprises a one in sixteen binary counter having four binary stages. Each stage is coupled to a binary-to-digital decoder 104 to produce a single 0 bit enabling signal on one of twelve output lines 106. The twelve output lines 106 are respectively individually coupled to the twelve NOR gates 24. When decoder 104 detects a binary number representing a digital number greater than twelve, a 0 bit signal is coupled via line 154 to an octave counter 110 which comprises a one in four binary counter having two binary stages. The first stage has opposite outputs *a* and *a*, and the second stage has opposite outputs *b* and *b*, forming output lines 112 which are coupled to a binary-to-digital decoder 114 which is illustrated in detail. When octave counter 110 is in a state corresponding to the digital number one, the Octave 1 (01) NOR gate 114 produces a 1 bit on an output line 116. Similarly, output lines 117, 118 or 119 have 1 bits thereon when the octave NOR gates 02, 03, and 04 detect the corresponding digital numbers two, three and four. Both counters 102 and 110 have reset inputs enabled by a 0 bit coupled over a reset line 122 from the start control 124.

Start control 124 has a 0 bit output from a NOR gate 126 when the start control is in its reset or rest state. The 0 bit resets counters 102 and 110 to their digital zero representing count or state. Also, a NOT gate 128 produces a disabling 1 bit which saturates gating transistor 54, preventing the clock pulses from being coupled to output line 70.

When the start control 124 produces a 1 bit output from NOR gate 126, transistor 54 is enabled and the first passed clock pulse causes the counter 102 to count to a digital one number. This enables the lowest frequency or tone NOR gate 24, which herein is the F note. If the F switch 20 is not closed, then the output of the F NOR gate 24 remains a 0 bit. Thus, no switching signal is produced on line 90, and hence the second clock pulse is passed to counter 102, causing it to step to its next count. In this manner, the counter 102 will continue to count until it enables a NOR gate 24 which also has a 0 bit input from a closed switch 20.

At such time, the NOR gate 24 will have two 0 bit inputs, producing a 1 bit which causes the corresponding NOT gate 149 and line 90 to have a 0 bit output. This disables NOR gate 82, enables NOR gate 83, and enables the divider 44 due to the 1 bit generated by NOT gate 86. The counter output line 80 has a 0 bit until divider 44 has completed counting the next 256 clock pulses. Before the clock pulse which originally enabled the NOR gate 24 is terminated, the 0 bit on line 80 along with the 0 bit on line 90 causes NOR gate 83 to generate a 1 bit in order to maintain the 0 bit output of NOR gate 84. Thus, counter 102 is stopped or held in its present count until after 256 clock pulses have occurred. The 1 bit output of NOR gate 83 is also coupled through a resistor 140 to forward bias a transistor 142. The forward biased transistor 142 couples an output line 144 to ground 65. The line 144 may be connected to a key bus control so that the key bus will be turned on and off following the output level changes in NOR gate 83.

While the counter 102 is being held, the 1 bit output from the NOR gate 24 is also coupled through a NOT gate 149 to four NOR gates 150, each of which is associated with the same musical note, but in four different octaves. Each NOR gate 150 has a note input coupled to a corresponding NOR gate 24, and an octave input coupled to one of the output lines 116–119 of the octave counter/decoder. The outputs of NOR gates 150 are coupled to keyers 30 which produce tone signals corresponding to the note, and in the octave of, the actuated NOR gate 150.

Assuming that only the E switch 20 was depressed when the cycle control was started, then clock 40 and switch 42 would pass clock pulses to counter 102 until the digital twelve count enabled the E NOR gate 24. The twelve count would now be held since switch 42 would insert the divider 44 in the clock path between the clock and the counter. The E note signal would now be coupled to all four E NOR gates 150. Since counter 110 is in its zero digital state, the 01 NOR gate 114 has a 1 bit output which is negated by a NOT gate to enable the E NOR gate 150 associated with the Octave 1 group. After counting 256 pulses, the E output would terminate, and counter 102 would be stepped and generate an output on line 154 to enable the 02 NOR gate 114. Then the counter 102 would step to its last state, causing decoder 104 to generate a 0 on a line 156 coupled to the start control 124 (which has no effect at this time).

The next clock pulse causes the counter 102 to begin a new counting cycle, and further clock pulses again sequentially enable the NOR gates 24. Upon reaching the E NOR gate 24, corresponding to the still actuated E keyswitch 20 a negated one bit would be produced to actuate the E NOR gate 150 associated with the Octave 2 group of gates. The keyers 30 would sound an E tone in the second octave of the electronic organ.

After all four octaves had been enabled, the last count line 156 would have a 0 bit while a NOR gate 160, which forms a part of the start control 124, also had a 0 bit on a last Octave line 161 from a NOT gate 159 coupled to the output of the 04 NOR gate 114. This will stop the clock pulses from being passed through transistor 54, and will clear the counters 102 and 110 (although the counter reset operation has no effect at this time since the counters would next step to their zero state in any event).

In particular, the presence of two 0 bits at NOR gate 160 generates a 1 bit output which is negated by a NOT gate 162 to produce a 0 bit input to a NOR gate 164. Assuming that a start switch 170 is now on a stop terminal 172, rather than on a start terminal 174, then the other input line 178 of NOR gate 164 also has a 0 bit, due to coupling to ground 65 through a resistor 176. The pair of 0 bits generate a 1 bit which causes NOR gate 126 to have a 0 bit output, which clears the counters 102 and 110 and also decouples the clock from output line 70 by saturating transistor 54 due to the one bit output of NOT gate 128.

Start control 124 also includes a pair of NOR gates 180 and 182 which are cross-coupled to form a flip-flop. The output of NOR gate 180 is coupled through a capacitor 184 and a NOT gate 186 to the other input of NOR gate 126. The junction between capacitor 184 and NOT gate 186 is coupled through a resistor 190 to a positive potential DC source. The stop terminal 172 is coupled to a lower input of NOR gate 182, and is also coupled through a resistor 192 to ground 65.

When a sequential tone generation cycle is again to be started, switch 170 is momentarily thrown to terminal 174, producing a 1 bit on line 178 and at the input of NOR gate 180. The output of NOR gate 180 now goes low, which change in state is coupled by capacitor 184 to the input of NOT gate 186. Since the NOT gate 186 produces a momentary 1 bit to the input of gate 126, even though the 1 bit on line 178 produces a 0 bit to the other input of NOR gate 126, its output remains a 0 bit (which still prevents the clock 40 from passing clock pulses). However, as the pulse through capacitor 184 disappears, the inputs to NOR gate 126 are two 0 bits, producing a 1 bit output which releases the clock 40 by allowing the clock pulses to pass through transistor 54.

Assuming that an arpeggio sequence has been initiated and that the counters 102 and/or 110 are at some intermediate numbers, the arpeggio can be restarted by actuation of switch 170. The actuation produces a 1 bit to NOR gate 180, generating a momentary 1 bit to NOR gate 126 and causing line 122 to change to a 0 bit. This resets the counters 102 and 110 to their zero count, and disables the transistor 54. As soon as the 1 bit output of NOT gate 186 disappears, the output of NOR gate 126 will switch to a 1 bit and hence the clock 40 will pass clock pulses to the now reset counters. This causes the arpeggio operation to begin over, and continue until either all gates 150 has been scanned in sequence or until a new arpeggio operation is initiated by again depressing the start switch 170.

It should be understood that the above description of operation with only one of the playing selector controls 20 actuated is not the only method of use of the invention. Operation is essentially the same when any number of playing selector controls 20 are simultaneously actuated. In the preferred embodiment of this invention, the playing selector controls 20 are lower keyboard keys on a two manual electronic organ. In the common use of this preferred embodiment by a musician, keys producing a musical chord are actuated on the lower manual keyboard with the left hand and the start switch 170 is actuated by the right foot. If the keys actuated by the left hand produce a F major chord (Notes FAC) and the start switch is actuated, an evenly spaced F major arpeggio will be automatically sounded, i.e., the notes F A C will be sequentially sounded in every octave from the lowest to the highest.

It should also be understood that one skilled in the art can add additional logic circuitry to change this up only arpeggio system to an up and down system, or modify the system to also produce glissando, strum and other variations. It will also be obvious to those skilled in the art that the system could be driven by an electronic rhythm device so that the arpeggio or variation notes are sounded in a rhythmic instead of an evenly spaced manner.

Having described the invention, the embodiments of the invention in which an exclusive property or privilege is claimed are defined as follows:

1. An electrical musical instrument comprising:

selection means for producing tone control signals representing musical tones which are to be produced;

a plurality of gates coupled to the selection means and each being individually enabled to pass a corresponding tone control signal if present when the gate is enabled;

keyer means coupled to the plurality of gates and responsive to the tone control signals passed by the gates for producing corresponding musical tones; and cycle means coupled to the plurality of gates for enabling the gates in sequence, including a clock for producing clock signals which are capable of stepping the cycle means to sequentially enable the gates, a divider for dividing the clock signals to produce divided clock signals which are capable of stepping the cycle means and which have a substantially longer time duration, and logic means for selecting either the clock signals or the divider clock signals to step the cycle means.

2. The electrical musical instrument of claim 1 wherein the logic means comprises a note detector responsive when an enabled gate passes a tone control signal for stepping the cycle means under control of the divided clock signals.

3. The electrical musical instrument of claim 2 wherein the note detector has a plurality of inputs coupled to the plurality of outputs of the gates for actuation by a tone control signal passed through any of the gates.

4. The electrical musical instrument of claim 1 wherein the cycle means includes a cycle input for stepping the cycle control in response to the clock signals, and the logic means includes a switch for inserting the divider between the clock and the cycle input.

5. The electrical musical instrument of claim 4 wherein the cycle means includes note counter means having a note counter input corresponding to the cycle input and a plurality of individually actuable note output lines, the plurality of note output lines being respectively coupled to the plurality of gates for sequentially enabling each gate in sequence in response to the count of the note counter means.

6. The electrical musical instrument of claim 5 wherein the cycle means includes an octave counter means having a plurality of octave input lines, and an octave counter input coupled to the note counter means for stepping the octave counter means once for each cycle of the note counter means, and a plurality of groups of gates coupled between the first-named plurality of gates and the keyer means, each group corresponding to a different octave, the octave output lines each being coupled to all gates within the same group and each count within the same group being coupled to different ones of the first-named plurality of gates.

7. The electrical musical instrument of claim 1 including start means for initiating a new sequential enabling of notes including a control gate for effectively passing and blocking the clock signals from the clock and a reset circuit responsive for resetting the cycle means to an initial stepping state.

8. The electrical musical instrument of claim 7 wherein the clock comprises a regenerative oscillator for continuously producing clock signals, the control gate being coupled between the regenerative oscillator and the logic means and actuable to couple the clock signals to the logic means.

9. An electrical musical instrument comprising:

selection means having a plurality of control lines each of which may carry a note control signal thereon;

a plurality of note gates each having an output and a first input coupled to a corresponding one of the plurality of control lines and a second input;

note counter means having a plurality of note cycle lines each coupled to different ones of the second inputs of the note gates, the count of the note counter means enabling a corresponding note cycle line to enable a corresponding one of the note gates;

keyer means responsive to note control signals for producing corresponding musical tones;

a plurality of groups of output gates having outputs coupled to the keyer means with each output gate having a first input and a second input, each group corresponding to a different octave of tones which can be produced by the keyer means and all output gates in the same group having their first inputs respectively coupled to the outputs of corresponding different ones of the plurality of note gates;

octave counter means having a plurality of octave cycle lines with each octave cycle line being coupled to all second inputs of all output gates in different ones of the groups of output gates in order that the count of the octave counter means will simultaneously enable all output gates in the same group;

clock means for generating clock pulses to cause the note counter means to count; and an octave cycle circuit for causing the octave counter means to count after each complete cycle of counting of the note counter means.

10. The electrical musical instrument of claim 9 wherein the note counter means comprises a binary counter responsive to the clock pulses for producing binary output signals, and a binary-to-digital decoder responsive to the binary output signals for generating a single count representing signal on a corresponding single one of the note cycle lines.

11. The electrical musical instrument of claim 10 wherein the octave cycle circuit is coupled to the binary-to-digital decoder and is responsive after all note cycle lines have been enabled for generating a cycle complete pulse which steps the octave counter means to its next count.

12. The electrical musical instrument of claim 9 wherein the clock means includes an oscillator for producing clock pulses at a high frequency, a divider responsive to the clock pulses for producing divided clock pulses at a lower frequency, and logic means for coupling either the higher frequency clock pulses or the lower frequency divided clock pulses to the note counter means to cause it to count.

13. The electrical musical instrument of claim 12 wherein the logic means comprises a note detector coupled to the outputs of the plurality of note gates for detecting the presence of a note control signal passed by an actuated note gate, the note detector being responsive to a detected note control signal for coupling the divided clock pulses to the note counter to substantially lengthen the note interval.

14. The electrical musical instrument of claim 13 wherein the logic means includes a first control gate coupled between the clock means and the note counter means and a second control gate in series with the divider, the series combination of the divider and the second control gate being coupled between the clock means and the note counter means, and the note detector being coupled to enable either the first control gate of the second control gate depending on the detected absence or the detected presence of note control signals, respectively.

15. The electrical musical instrument of claim 9 including a start control having a control gate forming a part of the clock means for effectively passing or blocking the clock pulses, and a reset means responsive to initiation of a new cycle of operation for clearing the counts of the note counter means and the octave counter means.

* * * * *